United States Patent [19]

Nishikawa

[11] 4,040,731

[45] Aug. 9, 1977

[54] ELECTROPHOTOGRAPHIC APPARATUS HAVING A SCREEN-TYPE PHOTOCONDUCTIVE DRUM

[75] Inventor: Masaji Nishikawa, Hachioji, Japan

[73] Assignee: Olympus Optical Co., Ltd., Tokyo, Japan

[21] Appl. No.: 672,444

[22] Filed: Mar. 31, 1976

[30] Foreign Application Priority Data

Apr. 4, 1975 Japan ..... 50-41080
Apr. 5, 1975 Japan ..... 50-40819

[51] Int. Cl.[2] ..... G03G 15/02; G03G 15/22

[52] U.S. Cl. ..... 355/3 R; 361/229; 355/30

[58] Field of Search ..... 355/3 R, 3 SC, 3 CH, 355/15, 30; 317/262 A; 96/1 R, 1 PC; 101/DIG. 13; 361/229

[56] References Cited

U.S. PATENT DOCUMENTS

| | | | |
|---|---|---|---|
| 3,862,420 | 1/1975 | Banks et al. | 101/DIG. 13 |
| 3,936,184 | 2/1976 | Tanaka et al. | 355/15 |
| 3,985,432 | 10/1976 | Hou et al. | 355/3 SC |

*Primary Examiner*—L. T. Hix
*Assistant Examiner*—Kenneth C. Hutchison

[57] ABSTRACT

An electrographic apparatus which makes use of a corona charge device and which is constructed to effectively remove detrimental gas such as ozone and dust produced in the corona charge device. The apparatus comprises a drum type screen photosensitive body rotatably mounted on a rotatable shaft and a substantially hermetically sealed cylindrical cover for surrounding the photosensitive body. The cylindrical cover is provided at its periphery with an air inlet opening and an ion outlet opening opposed to an ion discharge wire provided for the corona charge device. A fan is opposite the air inlet opening and is provided at its suction side with a filter and a heater.

4 Claims, 4 Drawing Figures

ELECTROPHOTOGRAPHIC APPARATUS HAVING A SCREEN-TYPE PHOTOCONDUCTIVE DRUM

BACKGROUND OF THE INVENTION

This invention relates to an electrographic apparatus which makes use of a corona charge device and which is constructed to effectively remove detrimental gas such as ozone and dust produced in the corona charge device.

A photosensitive body for electrographic apparatuses, particularly a photosensitive body formed of zinc oxide-resin photosensitive material or selenium or selenium alloy photosensitive material and most frequently used for electrographic apparatuses is charged with the aid of a flow of ions delivered from a corona charge device and can control the flow of ions.

In the conventional corona charge device, a corona discharge wire provides a source of ions, and the electric field produced between the corona discharge wire and a field electrode directs a flow of ions toward a record sheet disposed on the field electrode. Generation of such flow of ions, however, is accompanied by a detrimental gas such as ozone and the like which is liable to deteriorate the charge characteristics of the photosensitive body.

In FIG. 1 is shown a graph which illustrates influence of a detrimental gas such as ozone and the like upon a photosensitive body. A curve *a* shows an electric potential applied to the photosensitive body formed of selenium after it has been subjected to ozone and repeatedly charged and discharged, while a curve *b* shows an electric potential applied to the same photosensitive body after it has been repeatedly charged and discharged during which ozone is removed.

As seen from the curve *b*, if ozone is removed from the photosensitive body, the electric potential applied to the photosensitive body is substantially the same, even after charge and discharge have been repeated for about 40,000 times.

On the contrary, if the photosensitive body is subjected to ozone, the electric potential applied thereto becomes remarkably decayed in darkness as shown by the curve *a*.

The reasons why the electric potential on a photosensitive body formed of selenium is remarkably decayed in darkness when it is subjected to ozone are not clearly understood, but it is conceivable that such decay of the electric potential in darkness is caused by crystallization of selenium.

Experimental tests have yielded the result that the photosensitive body formed of zinc-resin photosensitive material shows a more significant decay in darkness of the electric potential applied thereto.

A few attempts have been made to alleviate the influence of detrimental gas such as ozone and the like upon the corona charge device. Such attempts are mainly divided into two measures, one of which is to decrease generation of ozone per se and the other is to remove ozone generated so as not to act upon the photosensitive body.

In FIG. 2 is shown one example of a conventional corona charge device which makes use of the above mentioned latter measure. Two corona discharge wires 1, 1' are connected in common to a negative terminal of a high voltage source 2, the other terminal of which is connected to ground. A shield electrode 3 is connected to ground and a field electrode 4 is also connected to ground. The corona charge device constructed as above described provides a source of ions, and the electric field produced between the corona discharge wires 1, 1' and the field electrode 4 directs a flow of ions toward a record sheet 5 positioned in overlying contact with the grounded field electrode 4. The density of the flow of ions becomes large at the side of the shield electrode 3 if compared with that of the flow of ions at the side of the field electrode 4. As a result, a negative voltage is applied to the shield electrode 3 and ozone generated is attracted to the shield electrode 3 and removed out of the corona charge device.

Such a conventional measure has the disadvantage that a large current flows toward the shield electrode 3, so that current flowing toward photosensitive body 6 becomes decreased thereby degrading the charge efficiency thereof.

In addition, provision may be made of a fan 7 opposed to the shield electrode 3 as shown by dotted lines in FIG. 2 so as to effect a forced attraction of ozone toward the fan 7 to discharge it out of the corona charge device. Such a measure is effective and reliable in operation, but it also has the disadvantage that it is not always easy to construct and arrange the fan 7 such that ozone can effectively be removed from a space extending along the overall length of the corona discharge wires 1, 1'.

A known electrographic apparatus which makes use of a drum type screen photosensitive body has the disadvantage that dust adhered to the photosensitive body 6 is reproduced as an enlarged white point on the record sheet 5, and minute dust deteriorates the charge characteristic of the photosensitive body 6. Experimental tests have also yielded the result that the charge characteristic of the photosensitive body 6 significantly deteriorates when a considerable amount of moisture is present.

In such an electrographic apparatus, the record sheet 5 must be arranged very near the photosensitive body 6 and fed along the latter. In addition, a high voltage electric field is applied between the record sheet 5 and the photosensitive body 6. As a result, if the record sheet 5 makes contact with the photosensitive body 6, the high voltage electric field is short circuited, and hence there is a risk of the photosensitive body 6 being permanently broken. In order to avoid such a short ciruit, provision may be made of a member for urging the record sheet against the field electrode. The use of such a member, however, results in a standstill of the record sheet that will tend to bring the record sheet 5 into contact with the photosensitive body 6.

An object of the invention is to provide an electrographic apparatus provided with an ozone removing device which can obviate the above mentioned disadvantage which has been encountered with the conventional ozone removing device and which is effective and reliable in operation.

Another object of the invention is to provide an electrographic apparatus which prevents the drum type screen photosensitive body from being adhered with minute dust, makes the life of the screen photosensitive body long, provides an improvement in quality of the electrostatic charge image corresponding to an image to be recorded on the record sheet, provides a decrease in deterioration of the charge characteristic of the screen photosensitive body when a considerable amount of moisture is present, prevents a permanent breakage of the screen photosensitive body due to contact with the record sheet, and provides an improvement in quality of the electrostatic charge image formed on the record sheet.

SUMMARY OF THE INVENTION

A feature of the invention is the provision of an electrographic apparatus comprising a drum type screen photosensitive body rotatably mounted on a rotatable shaft, a corona charge device located along the periphery of said photosensitive body and including a corona discharge wire connected through a high voltage source to ground, a grounded shield electrode and a grounded field electrode, said photosensitive body being interposed between said corona discharge wire and said shield electrode, a substantially hermetically sealed cylindrical cover for surrounding said photosensitive body and provided at its periphery with an air inlet opening and an ion outlet opening opposed to said ion discharge wire, and a fan opposed to said air inlet opening, whereby air under pressure is introduced through said air inlet opening into said cylindrical cover and discharged therefrom through said ion outlet opening.

BRIEF DESCRIPTION OF THE DRAWINGS

The invention will now be described in greater detail with reference to the accompanying drawings, wherein.

DESCRIPTION OF THE PREFERRED EMBODIMENTS

Figure 3:
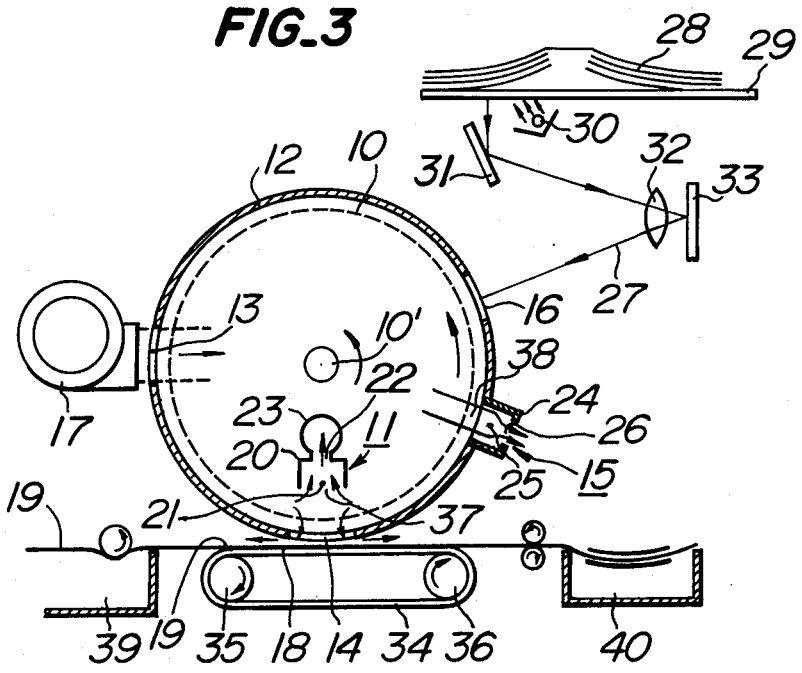
FIG. 3 shows schematically one embodiment of the electrographic apparatus according to the invention.

Referring to FIG. 3, reference numeral 10 designates a photosensitive body formed of a drum type screen constructed, for example, by a closed cylinder provided with a number of meshes formed by etching and rotatably mounted on a rotational shaft 10' and rotated about it in a counter-clockwise direction shown by an arrow.

The principle of electrography using such screen photosensitive body 10 has been well known in the art. In the drum type screen photosensitive body 10 there is arranged a corona charge device 11. The photosensitive body 10 is surrounded by a cylindrical cover 12 which is hermetically closed and provided at one side with an air inlet opening 13 through which an air stream is introduced into the cylindrical cover 12 and at its lower side with an ion outlet opening 14 located at that part of the cylindrical cover 12 which is opposed to the corona charge device 11 and having a width of the order of, for example, 15 mm, a flow of ions being passed through the ion outlet opening 14. The cylindrical cover 12 is provided at the opposite side with a corona charge device 15 arranged outside the photosensitive body 10, and, at that side which precedes the corona charge device 15, is provided with a window 16 through which a light image 27 is irradiated upon the photosensitive body 10.

A printed matter 28 to be reproduced is disposed on a table 29 and illuminated by a light emitted from an illumination device 30. Light reflected from the printed matter 28 is directed by a reflecting mirror 31, a projection lens 32 and a reflecting mirror 33 upon the photosensitive body 10 as the light image 27.

To the air inlet opening 13, there is opposed a fan 17. To the ion outlet opening 14, there is opposed a field electrode 18 composed of, for example, an endless conveyor belt 34 driven by a pair of rollers 35, 36 for feeding a record sheet 19.

The corona charge device 11 arranged in the drum type screen photosensitive body 10 is provided with a shield electrode 20 formed of an elongated rectangular closed vessel which is open at its bottom wall to define an opening 37 and provided at its top wall with a groove-like opening 22 extending in a lengthwise direction of a corona discharge wire 21. The groove-like opening 22 is connected to a conduit 23. The conduit 23 extends through each end wall of both the screen 10 and the cylindrical cover 12 and communicates with the outside of the cylindrical cover 12.

The corona charge device 15 provided for the outer periphery of the cylindrical cover 12 is provided with a shield electrode 24 formed of an elongated rectangular closed vessel which is open at its bottom wall to define an opening 38 and provided at its top wall with a groove-like opening 26 extending in a lengthwise direction of a corona discharge wire 25.

The operation of the electrographic apparatus shown in FIG. 3 is as follows. In the first place, the corona charge device 15 charges the screen photosensitive body 10 uniformly, and then the screen photosensitive body 10 is irradiated through the window 16 by the light image 27 to form an electrostatic latent image corresponding to the irradiated light image on the screen photosensitive body 10.

When the screen photosensitive body 10 is rotated and the electrostatic latent image arrives at a position opposed to the corona charge device 20, the screen photosensitive body 10 is subjected to the flow of ions from the corona discharge wire 21 to form thereon an electrostatic charge image corresponding to an image to be recorded on the record sheet 19. The record sheet 19 with the electrostatic charge image formed thereon is then subjected to treatments, such as developing, fixing, drying and the like to provide a complete hard copy.

In the present embodiment, the record sheet 19 is transferred from a feeding device 39 through the endless belt 34 constituting the field electrode 18 to a developing tank 40 in which the electostatic latent image on the record sheet 19 becomes visible.

Figure 1:
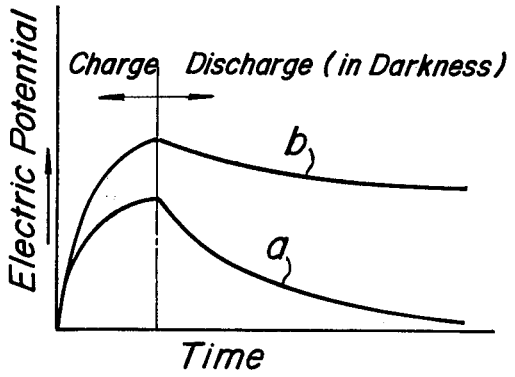
FIG. 1 shows a graph which illustrates electric potential applied to an electrographic photosensitive body versus time elapsed.
Figure 2:
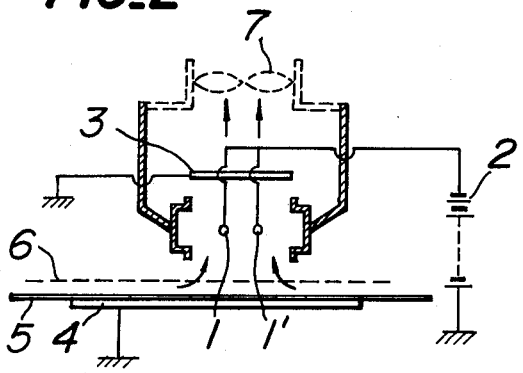
FIG. 2 is a simplified illustration of a conventional corona charge device.

In general, when the corona charge device is used to charge the photosensitive body 10, detrimental gas such as ozone and the like is produced in the corona charge device to deteriorate the photosensitive body 10, and as a result, a good result cannot be obtained. For example, in an electrographic apparatus for controlling a flow of ions by means of a screen photosensitive body, it is possible, in principle, to obtain a number of copies by one light exposure of the photosensitive body; such an effect, however, cannot be attained with a photosensitive body which is so deteriorated that it shows significantly large dark decay, that is, a rapid dissipation of the electric charge in darkness as shown by the curve *a* in FIG. 1.

In order to obviate such a disadvantage, in accordance with the invention, provision is made of the fan 17 to supply air under pressure through the air inlet opening 13 into the closed cylindrical cover 12. Part of the air is discharged through the ion outlet opening 14 out of the closed cylindrical cover 12, but the remaining air is discharged through the groove-like opening 22 into the conduit 23 provided for the shield electrode 20 of the corona charge device 11 and then discharged out of the closed cylindrical cover 12 as well as through the groove-like opening 26 of the shield electrode 24 out of the closed cylindrical cover 12. This air stream discharged through the corona charge devices 11, 15 to the outside of the closed cylindrical cover 12 is capable of expelling the detrimental gas such as ozone and the like produced in the corona charge devices 11, 15.

In addition, the air stream injected through the ion outlet opening 14 of the closed cylindrical cover 12 causes the electrostatic record sheet 19 to urge against the field electrode 18, and as a result, there is no risk of the screen photosensitive body 10 being broken by bringing the electrostatic record sheet 19 into contact with the screen photosensitive body 10.

Figure 4:
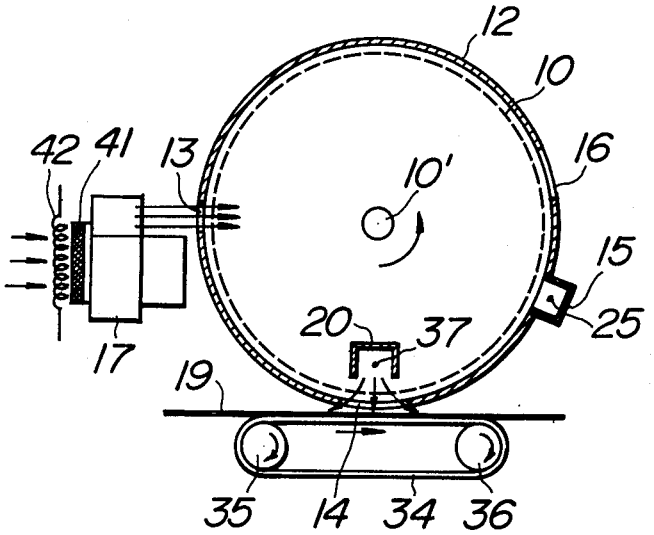
FIG. 4 shows schematically another embodiment of the electrophraphic apparatus according to the invention.

In FIG. 4 is shown another embodiment of the electrographic apparatus according to the invention.

In the present embodiment, provision is made of a filter 41 opposed to the suction side of the fan 17 and also a heater 42 arranged outside the filter 41.

In the present embodiment, the cylindrical cover 12 is filled up with the air stream under pressure after it has passed through the filter 41 and has been deprived of minute dust, and as a result the air stream-discharged through any other gaps provided for assembling, adjusting, replacing, or effecting power transmission of mechanical and electrical elements-can prevent dust from penetrating through such gaps into the cylindrical cover 10. In addition, the air stream also serves to remove dust which has penetrated into the cylindrical cover 10 at the rest time of the electrographic apparatus.

In addition, the heater 42 serves to heat the air stream introduced into the cylindrical cover 12 and hence reduce effective humidity therein. The heater 42 is also utilized to improve the charge characteristic of the screen photosensitive body 10 when it is used at an extremely low temperature, by dehumidifying and slightly heating a local space inclusive of the drum type screen photosensitive body 10 when the space contains a considerable amount of moisture at a low temperature.

As seen from the above, the electrographic apparatus according to the invention can effectively prevent the drum type screen photosensitive body 10 from being degraded by a detrimental gas such as ozone and the like and also being coated with dust. As a result, it is possible to improve the electrostatic charge image formed on the record sheet 19 and at the same time lengthen the life of the screen photosensitive body 10.

The invention is not limited to the above mentioned embodiments, but various changes and modifications may be made. For example, the drum shaped screen photosensitive body may be replaced by a flat type photosensitive body. In addition, the conduit 23 connected with the outside of the closed cylindrical cover 12, and removing detrimental gas such as ozone and the like out of the closed cylindrical cover 12, may be replaced by an ozone absorption and decomposition device located at the rear side of the groove-like opening 22 provided for the shield electrode 20, thereby preventing ozone from being transferred to the outside.

What is claimed is:

1. An electrographic apparatus comprising:

a drum type screen photosensitive body rotatably mounted on a rotatable shaft, a corona charge device located along the periphery of said photosensitive body and including a corona discharge wire connected through a high voltage source to ground, a grounded shield electrode and a grounded field electrode, said photosensitive body being interposed between said corona discharge wire and said shield electrode, a substantially hermetically sealed cylindrical cover for surrounding said photosensitive body and having at its periphery an air inlet opening and an ion outlet opening opposite to said corona discharge wire, and a fan opposite to said air inlet opening, whereby air under pressure is introduced through said air inlet opening into said cylindrical cover and discharged therefrom through said ion outlet opening.

2. An electrographic apparatus as claimed in claim 1, wherein said shield electrode is formed of an elongate rectangular vessel open at its bottom wall to define an opening and having at its top wall a groove-like opening extending in a lengthwise direction of said corona discharge wire, said groove-like opening being connected to a conduit extending through each end wall of both said photosensitive body and said cylindrical cover and communicated with the outside of said cylindrical cover.

3. An electrographic apparatus as claimed in claim 2, including an ozone absorption and decomposition device located at the rear side of said groove-like opening provided for said shield electrode.

4. An electrographic apparatus as caimed in claim 1, wherein said fan has at its suction side a filter and a heater arranged outside said filter.

* * * * *